US005682117A

United States Patent [19]

Choi et al.

[11] Patent Number: 5,682,117

[45] Date of Patent: Oct. 28, 1997

[54] HALF POWER SUPPLY VOLTAGE GENERATING CIRCUIT IN A SEMICONDUCTOR MEMORY DEVICE

[75] Inventors: Hoon Choi; Moon-Gone Kim, both of Suwon, Rep. of Korea

[73] Assignee: Samsung Electronics Co., Ltd., Suwon, Rep. of Korea

[21] Appl. No.: 660,213

[22] Filed: Jun. 3, 1996

Related U.S. Application Data

[63] Continuation of Ser. No. 541,269, Oct. 12, 1995, abandoned, which is a continuation of Ser. No. 233,786, Apr. 26, 1994, abandoned.

[30] Foreign Application Priority Data

Apr. 26, 1993 [KR] Rep. of Korea ..... 6990/1993

[51] Int. Cl.[6] ..... G05F 1/10

[52] U.S. Cl. ..... 327/530; 327/541; 327/543

[58] Field of Search ..... 307/296.1, 296.4, 307/296.5, 296.6, 296.8; 365/228, 189.09, 227; 327/535, 537, 538, 543, 530, 541

[56] References Cited

U.S. PATENT DOCUMENTS

| | | | |
|---|---|---|---|
| 3,053,997 | 9/1962 | Cobbold | 307/296.6 |
| 4,368,524 | 1/1983 | Nakamura et al. | 365/189.09 |
| 4,442,398 | 4/1984 | Bertails et al. | 327/535 |
| 4,663,584 | 5/1987 | Okada et al. | 327/537 |
| 4,910,707 | 3/1990 | Schrenk | 365/228 |
| 4,930,112 | 5/1990 | Tanaka et al. | 365/227 |
| 5,528,130 | 6/1996 | Okamura | 323/314 |

FOREIGN PATENT DOCUMENTS 5-327455 (A) 12/1993 Japan .

*Primary Examiner*—Timothy P. Callahan
*Assistant Examiner*—Jung Ho Kim
*Attorney, Agent, or Firm*—Cushman Darby & Cushman, IP Group of Pillsbury Madison & Sutro LLP

[57] ABSTRACT

A half Vcc generating circuit generates an accurate half supply voltage with high driving power. The half Vcc generating circuit includes a bias circuit supplied with an internal supply voltage and a driving circuit supplied with an external supply voltage. The internal supply voltage is independent of and lower than the external supply voltage.

18 Claims, 2 Drawing Sheets

HALF POWER SUPPLY VOLTAGE GENERATING CIRCUIT IN A SEMICONDUCTOR MEMORY DEVICE

This is a continuation of application Ser. No. 08/541,269, filed on Oct. 12, 1995, which was abandoned upon the filing hereof, which is a continuation of application Ser. No. 08/233,786, filed on Apr. 26, 1994, which was abandoned upon the filing hereof.

FIELD OF THE INVENTION

The present invention relates to a semiconductor memory device, and more particularly to a half power supply voltage generating circuit used for precharging signal lines such as bit lines to the half power supply voltage level.

BACKGROUND OF THE INVENTION

As the density of semiconductor memory devices increases, the size of unit memory cells decreases. The size reduction in memory cells should lead to a reduction in the power supply voltage Vcc supplied to semiconductor memory devices. However, the voltage reduction could result in decreasing the operating speed of memory cells. Accordingly, there is a strong demand for increasing the operational speed as well as the density of semiconductor memory devices. To meet this demand, various methods have been proposed.

One method is to precharge the bit lines to a predetermined voltage. Generally, in a semiconductor memory device to which a high power supply voltage is provided the bit lines are precharged to the power supply voltage level. Alternatively, in a semiconductor memory device to which a low power supply voltage is provided the bit lines are precharged to a half power supply voltage level to reduce current consumption and to achieve high speed data access. The half power supply voltage generator (hereinafter referred to as "half Vcc generator") is more widely used today.

FIG. 1 shows a conventional half Vcc generator made by using a CMOS process, which is disclosed in U.S. Pat. No. 4,663,584. As shown in FIG. 2, the conventional half Vcc generator is provided with internal supply voltage Vccp generated from voltage dropping circuit 20 for peripheral circuit 40, to reduce current consumption.

The half Vcc generator comprises bias circuit 51 for generating first and second reference voltages in dependence upon the level of internal supply voltage Vccp, and driving circuit 52 for outputting half supply voltage $V_M$ in dependence upon the first and second reference voltages. The bias circuit 51 includes NMOS transistor Q1 and PMOS transistor Q2 connected serially between internal supply voltage Vccp for peripheral circuit 40 and ground voltage Vss, pull-up resistor R1 and pull-down resistor R2. The gate and drain of transistor Q1 are commonly connected to internal supply voltage Vccp at node n1 to which the first reference voltage is outputted. The source and gate of the transistor Q2 are commonly connected to the source of transistor Q1 at node n3. The driving circuit 52 includes NMOS transistor Q3 and PMOS transistor Q4 connected serially between internal supply voltage Vccp for peripheral circuit 40 and ground voltage Vss. The gate of transistor Q3 is connected to node n1 and the drain of transistor Q3 is connected to internal supply voltage Vccp. The gate of transistor Q4 is connected to node n2, the source of transistor Q4 is connected to the source of transistor Q3 and the drain of transistor Q4 is connected to ground voltage Vss. Then half supply voltage $V_M$ between internal supply voltage Vccp, for peripheral circuit 40, and ground voltage Vss is outputted at node n4.

When the voltage at node n3 becomes ½•Vccp by adjusting the ratio of the channel resistances of transistors Q1 and Q2, and the ratio of pull-up and pull-down resistors R1 and R2, the voltage at node n1 becomes ½•Vccp+$V_{tQ1}$ (where $V_{tQ1}$ represents the threshold voltage of transistor Q1) and the voltage at node n2 becomes ½•Vccp−$V_{tQ2}$ (where $V_{tQ2}$ represents the threshold voltage of transistor Q2). Under this condition, since the voltage at the gate of transistor Q3 becomes ½•Vccp+$V_{tQ1}$ and that at the drain of transistor Q3 becomes Vccp, transistor Q3 is turned on. Similarly, since the gate of transistor Q4 becomes ½•Vccp−$V_{tQ2}$, transistor Q4 is also turned on. Thus, the voltage at node n4 becomes ½•Vccp. If the voltage at node n4 increases to be higher than ½•Vccp, transistor Q4 is strongly turned on thereby holding the voltage at node n4 to ½•Vccp.

As shown in FIG. 2, external power supply voltage ext.Vcc is respectively supplied to voltage dropping circuit 10 for memory array 30, and to voltage dropping circuit 20 for peripheral circuit 40. Voltage dropping circuit 10 generates first internal supply voltage Vcca to memory array 30. Voltage dropping circuit 20 outputs internal supply voltage Vccp both to peripheral circuit 40 and half Vcc generator 50. Half Vcc generator 50 outputs half supply voltage Vccp to memory array 30. Since internal supply voltage Vccp is applied to half Vcc generator 50, the voltage output thereof becomes ½•Vccp. However, the ,supply voltage needed in memory array 30 is ½•Vcca. Therefore, if the level of first internal supply voltage Vcca applied to array circuit 30 is the same as that of second internal supply voltage Vccp applied to the peripheral circuit 40, there is no problem. However, if the level of the first internal supply voltage Vcca is different from that of the second internal supply voltage Vccp, it is difficult to output an accurate ½•Vcca.

SUMMARY OF THE INVENTION

It is therefore an object of the present invention to provide a half Vcc generating circuit for generating an accurate half power supply voltage with high driving power.

To achieve the object of the present invention, the half Vcc generating circuit according to the present invention includes a bias circuit supplied with an internal supply voltage and a driving circuit supplied with an external supply voltage. The internal supply voltage is independent of and lower than the external supply voltage.

BRIEF DESCRIPTION OF THE DRAWINGS

The above and other objects, advantages and features of the present invention will be more apparent from the following detailed description taken with the attached drawings in which.

DETAILED DESCRIPTION OF THE PREFERRED EMBODIMENT

Figure 3:
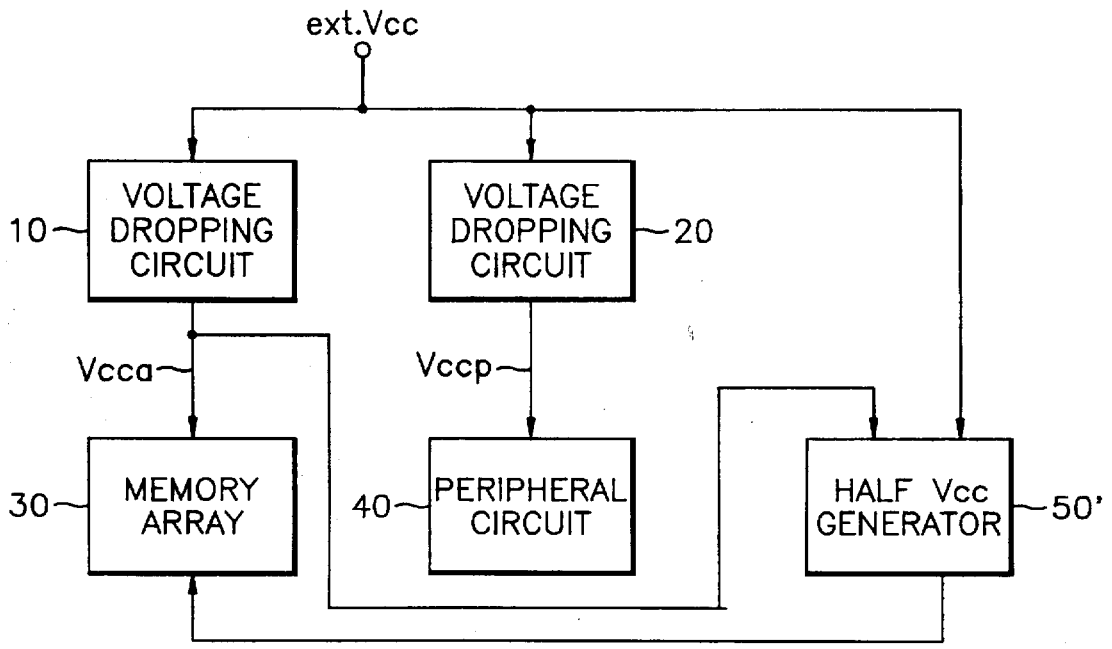
FIG. 3 is a block diagram showing the supply voltage connections to a half Vcc generator according to an embodiment of the present invention.

As shown in FIG. 3, external power supply voltage ext.Vcc is converted to first and second internal supply voltages Vcca and Vccp each being lower than the external power supply voltage ext.Vcc. The first internal supply voltage Vcca output from voltage dropping circuit 10 for memory array 30 and second internal supply voltage Vccp output from voltage dropping circuit 20 for peripheral circuit 40 may have the same or different voltage levels. If first internal supply voltage Vcca has the same voltage level as second internal supply voltage Vccp, the voltage output of half Vcc generator 50' may be connected to second internal supply voltage Vccp. On the contrary, however, if the first and second internal supply voltages are different from each other, it is preferable to provide half Vcc generator 50' with external power supply voltage ext.Vcc together with first internal supply voltage Vcca. In construction, first internal supply voltage Vcca output from voltage dropping circuit 10 for memory array 30, and external power supply voltage ext.Vcc are used as supply voltages in half Vcc generator 50'. Thus, it should be noted that a feature of the present invention is to supply half Vcc generator 50' with two independent supply voltages.

Figure 1:
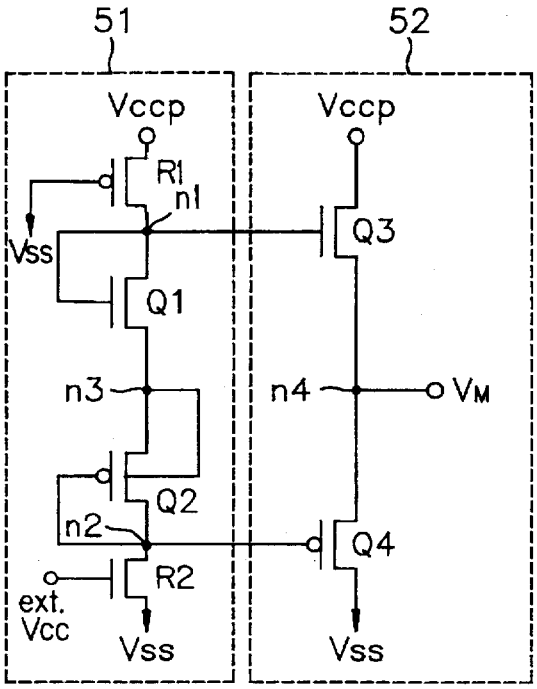
(PRIOR ART) FIG. 1
FIG. 1 is a circuit diagram showing a conventional half Vcc generator.
Figure 2:
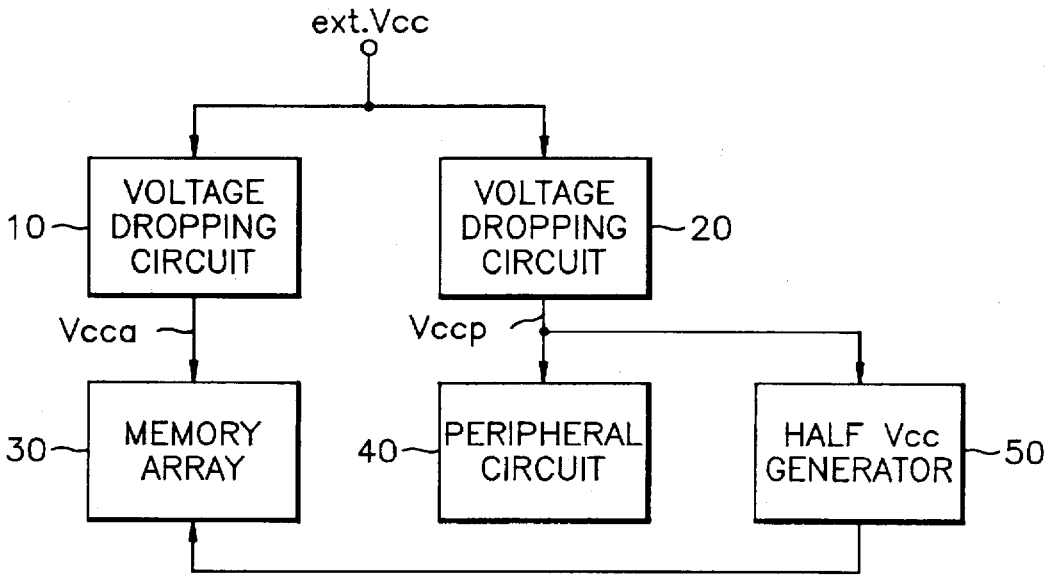
(PRIOR ART) FIG. 2
FIG. 2 is a block diagram showing the supply voltage connection to the conventional half Vcc generator.
Figure 4:
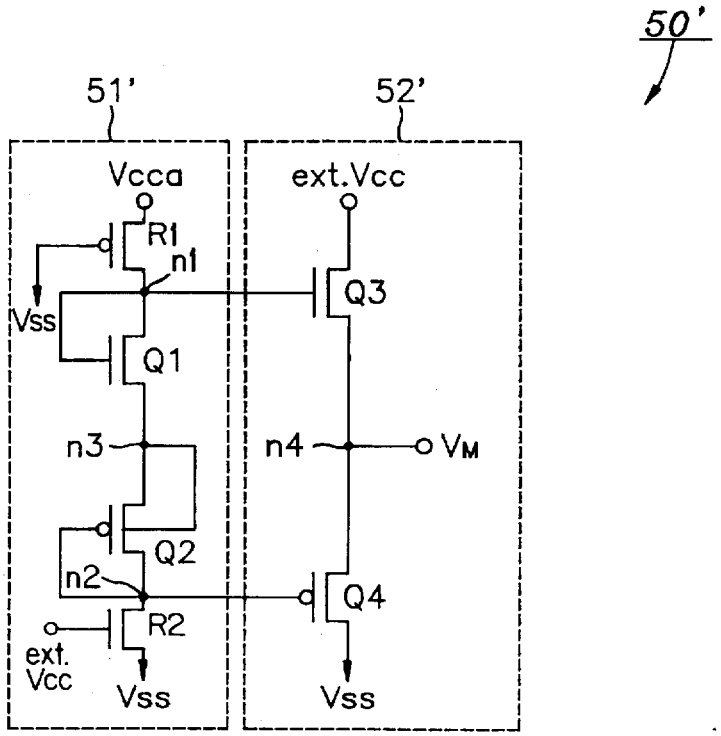
FIG. 4 is a circuit diagram showing a half Vcc generator according to an embodiment of the present invention.

As shown in FIG. 4, half Vcc generator 50' according to the present invention is composed of bias circuit 51', using first internal supply voltage Vcca output from voltage dropping circuit 10, and driving circuit 52', using external power supply voltage ext.Vcc. If supply voltage $\frac{1}{2}$•Vcca+$V_{tQ1}$ is stably provided to the gate of transistor Q3 of driving circuit 52', the voltage difference $V_{ds}$ between the drain and source of transistor Q3 increases compared with that of the prior art device of FIG. 1, since the drain of transistor Q3 is connected to external power supply voltage ext.Vcc which is higher than internal supply voltage Vccp. Thus, the current flowing through the channel of transistor Q3 is greater than in the prior art device. Therefore, the driving power of transistor Q3 becomes greater.

In the operation of half Vcc generator 50', the ratio of the channel sizes of NMOS transistor Q1 and PMOS transistor Q2 (i.e., the ratio of the channel resistances), and the ratio of the pull-up and pull-down resisters R1 and R2 are adjusted so as to generate an accurate voltage of $\frac{1}{2}$•Vcca at node n3. Then, the voltage at node n1 becomes $\frac{1}{2}$•Vcca+$V_{tQ1}$ and the voltage at node n2 becomes $\frac{1}{2}$•Vcca−$V_{tQ1}$. As mentioned above, since the voltage of the gate of transistor Q3 becomes $\frac{1}{2}$•Vcca+$V_{tQ1}$ and the voltage of the drain of transistor Q3 becomes ext.Vcc, the transistor Q3 is turned on, thereby rendering the voltage at node n4 to become $\frac{1}{2}$•Vcca. Further, since the voltage at node n2 is $\frac{1}{2}$•Vcca−$V_{tQ2}$, transistor Q4 is turned on allowing the voltage at node n4 to be kept at $\frac{1}{2}$•Vcca. It can be appreciated that the voltage at node n4 can be accurately maintained at $\frac{1}{2}$•Vcca by controlling the channel sizes of transistors Q3 and Q4. Therefore, the voltage at node n4 is not influenced by a variation in external power supply voltage ext.Vcc.

Since external power supply voltage ext.Vcc is used in driving circuit 52', the drain-source voltage $V_{ds}$ of transistor Q3 is comparatively high, so that the current flowing through the channel of transistor Q3 increases, thereby ensuring high driving power. Further, since the voltage output reaches the desired half Vcc more quickly, the operating speed of the circuit can be improved. Further, since the accurate half Vcc is obtained by half Vcc generator, the operation margin of a sense amplifier in sensing the bit lines is also improved, a maloperation of the memory device is prevented and the refresh characteristic of the memory cells is improved.

According to the embodiment of the present invention, first internal supply voltage Vcca and external power supply voltage ext.Vcc are both used as supply voltages respectively to bias circuit 51' and driving circuit 52' of half Vcc generator 50'. However, this is only an exemplary embodiment of the present invention showing that bias circuit 51' and driving circuit 52' are connected to independent supply voltages. As will be recognized by those skilled in the art the embodiment can be modified for example, by substituting a boosting voltage higher than external supply voltage ext.Vcc.

As described above, the half Vcc generator according to the present invention provides bias circuit 51' with first internal supply voltage Vcca used for memory array 30, and driving circuit 52' with external supply voltage ext.Vcc, thereby generating an accurate half Vcca with high driving power. Therefore, the driving power of the half Vcc generator increases. Consequently, the bit lines of the memory cell array are precharged to the accurate half Vcc and the sense amplifiers operate at high speed.

While the invention has been particularly shown and described with reference to a preferred embodiment, it will be understood by those skilled in the art that modifications in detail may be made without departing from the spirit and scope of the invention.

What is claimed is:

1. In a semiconductor memory device having an internal supply voltage and an external supply voltage, a half supply voltage generating circuit, comprising:

a bias circuit having a bias control input and a bias supply voltage input, said bias supply voltage input being connected to said internal supply voltage, said bias circuit being constructed and arranged to generate first and second reference voltages; and a driving circuit having first and second control inputs which respectively input said first and second reference voltages and a driving circuit supply voltage input connected to said external supply voltage, said driving circuit being constructed and arranged to generate a voltage with a level which is one-half of the internal supply voltage in response to the first and second reference voltages.

2. A circuit as claimed in claim 1, wherein the external supply voltage is higher than the internal supply voltage.

3. In a semiconductor memory device including a memory array and a peripheral circuit, and further including a first voltage dropping circuit constructed and arranged to supply a first internal supply voltage to the memory array based on an external supply voltage and a second voltage dropping circuit constructed and arranged to supply a second internal supply voltage to the peripheral circuit based on the external supply voltage, a half supply voltage generating circuit comprising:

a bias circuit having a bias control input and a bias supply voltage input, said bias supply voltage input being connected to the first internal supply voltage, said bias circuit being constructed and arranged to generate first and second reference voltages; and a driving circuit having first and second control inputs which respectively input said first and second reference voltages and a driving circuit supply voltage input connected to the external supply voltage, said driving circuit being constructed and arranged to generate a supply voltage which is one-half of the first internal supply voltage in response to the first and second reference voltages.

4. A circuit as claimed in claim 3, wherein the level of the first internal supply voltage is lower than the level of the external supply voltage.

5. A circuit as claimed in claim 1, wherein said bias circuit includes a plurality of serially connected transistors connected between said bias circuit supply voltage input and ground.

6. A circuit as claimed in claim 5 wherein said plurality of serially connected transistors includes:

a first transistor having a first gate connected to a first drain of said first transistor to establish a first node at which said first reference voltage is generated; and a second transistor having a second gate connected to a second drain of said second transistor to establish a second node at which said second reference voltage is generated.

7. A circuit as claimed in claim 6 wherein said plurality of serially connected transistors further includes:

a third transistor connected between said bias circuit supply voltage input and said first node; and a fourth transistor connected between said second node and ground.

8. A circuit as claimed in claim 7 wherein said first and fourth transistors are NMOS transistors and said second and third transistors are PMOS transistors.

9. A circuit as claimed in claim 6, wherein said driving circuit includes a plurality of serially connected transistors connected between said external supply voltage input and ground.

10. A circuit according to claim 6 wherein said driving circuit includes:

a first driving transistor having a first gate connected to said first node; and a second driving transistor having a second gate connected to said second node.

11. A circuit as claimed in claim 3, wherein said bias circuit includes a plurality of serially connected transistors connected between said bias circuit supply voltage input and ground.

12. A circuit as claimed in claim 11 wherein said plurality of serially connected transistors includes:

a first transistor having a first gate connected to a first drain of said first transistor to establish a first node at which said first reference voltage is generated; and a second transistor having a second gate connected to a second drain of said second transistor to establish a second node at which said second reference voltage is generated.

13. A circuit as claimed in claim 12 wherein said plurality of serially connected transistors further includes:

a third transistor connected between said bias circuit supply voltage input and said first node; and a fourth transistor connected between said second node and ground.

14. A circuit as claimed in claim 13 wherein said first and fourth transistors are NMOS transistors and said second and third transistors are PMOS transistors.

15. A circuit as claimed in claim 11, wherein said driving circuit includes a plurality of serially connected transistors connected between said external supply voltage input and ground.

16. A circuit according to claim 12 wherein said driving circuit includes:

a first driving transistor having a first gate connected to said first node; and a second driving transistor having a second gate connected to said second node.

17. A circuit as claimed in claim 1, wherein said bias control input is connected to said external supply voltage.

18. A circuit as claimed in claim 3, wherein said bias control input is connected to said external supply voltage.

* * * * *